United States Patent [19]

Schoonmaker et al.

[11] 4,228,997

[45] Oct. 21, 1980

[54] STACKING MACHINE

[75] Inventors: Edward B. Schoonmaker; Paul W. T. Moran, both of Rochester, N.Y.

[73] Assignee: Eastman Kodak Company, Rochester, N.Y.

[21] Appl. No.: 918,617

[22] Filed: Jun. 23, 1978

[51] Int. Cl.[3] ..... B65H 29/20; B65H 29/40

[52] U.S. Cl. ..... 271/315; 271/187

[58] Field of Search ..... 271/80, 187, 82, 208, 271/81, 83, 178, 277, 275, 315; 198/481, 654, 694; 414/81

[56] References Cited

U.S. PATENT DOCUMENTS

| | | | |
|---|---|---|---|
| 1,325,550 | 12/1919 | Wood . | |
| 1,573,414 | 2/1926 | Mahoney | 271/208 |
| 1,762,286 | 6/1930 | Wood | 271/80 |
| 1,905,687 | 4/1933 | Crafts . | |
| 1,955,514 | 4/1934 | Quick et al. . | |
| 1,956,541 | 4/1934 | Spillane . | |
| 2,067,565 | 1/1937 | DeManna . | |
| 2,109,050 | 2/1938 | Quick et al. . | |
| 2,403,062 | 7/1946 | Edwards . | |
| 2,406,118 | 8/1946 | Whitehead . | |
| 2,850,281 | 9/1958 | Heimlicher et al. . | |
| 3,062,537 | 11/1962 | Hanstein et al. . | |
| 3,355,169 | 11/1967 | Seyl | 271/187 |
| 3,390,508 | 7/1968 | Heimlicher . | |
| 3,409,290 | 11/1968 | Bergland | 271/187 X |
| 3,416,286 | 12/1968 | Ciccone . | |
| 3,429,240 | 2/1969 | Kawai et al. . | |
| 3,459,421 | 8/1969 | Motter . | |
| 3,773,322 | 11/1973 | Schlagbauer | 271/80 |
| 3,851,773 | 12/1974 | Kluge et al. | 214/6.5 |
| 3,912,255 | 10/1975 | McInerny | 271/80 |
| 4,088,314 | 5/1978 | Phillips | 271/187 X |

*Primary Examiner*—Bruce H. Stoner, Jr.
*Attorney, Agent, or Firm*—D. R. Arndt

[57] ABSTRACT

A stacking device for stacking random size sheets. The stacker is adapted to receive a steady or intermittent flow of sheets of varying lengths, widths, and thicknesses randomly discharged from a transport system. The sheets are received in any of a number of pockets which are formed by adjacent flexible webs; each of these webs is secured at one end to the peripheral edge of a disc. As the leading edge of the sheet enters the pockets, the curved configuration of the webs in conjunction with the pinching effect of the webs acts to decelerate each sheet. The carrier delivers the inserted sheets to a stripping station where the previously-inserted sheets are removed and deposited on a stacking platform.

7 Claims, 6 Drawing Figures

FIG. 2
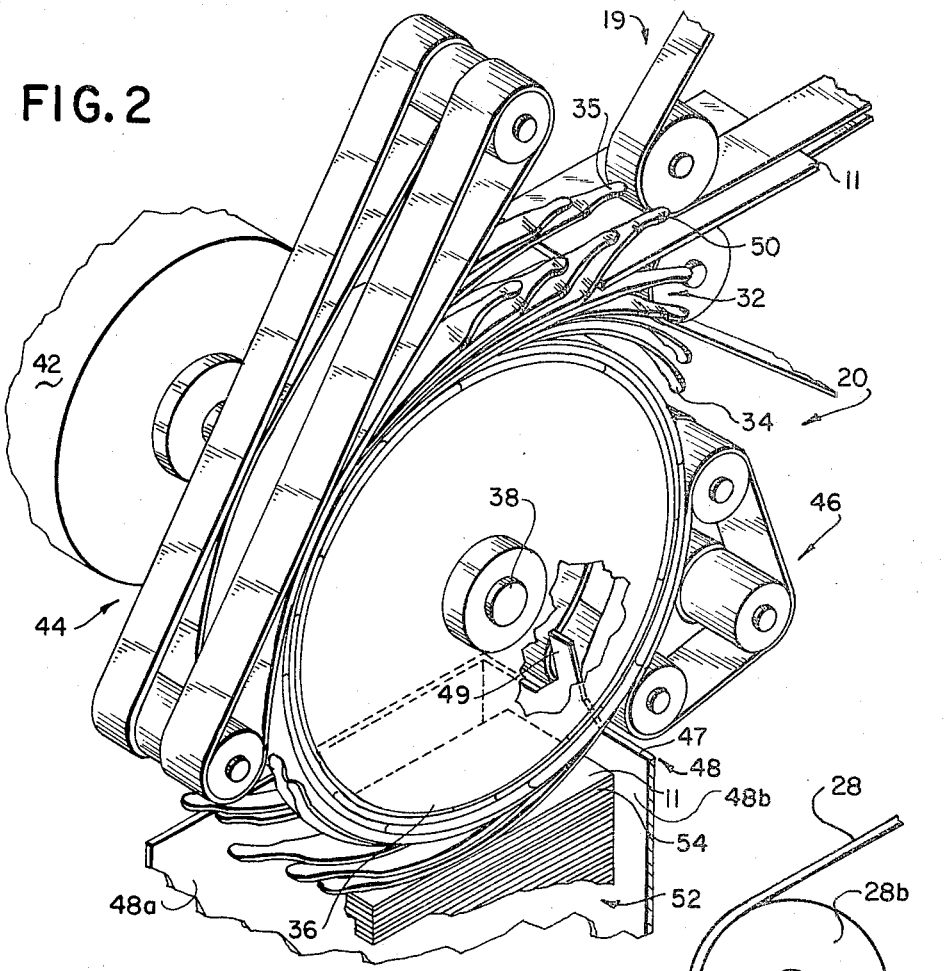
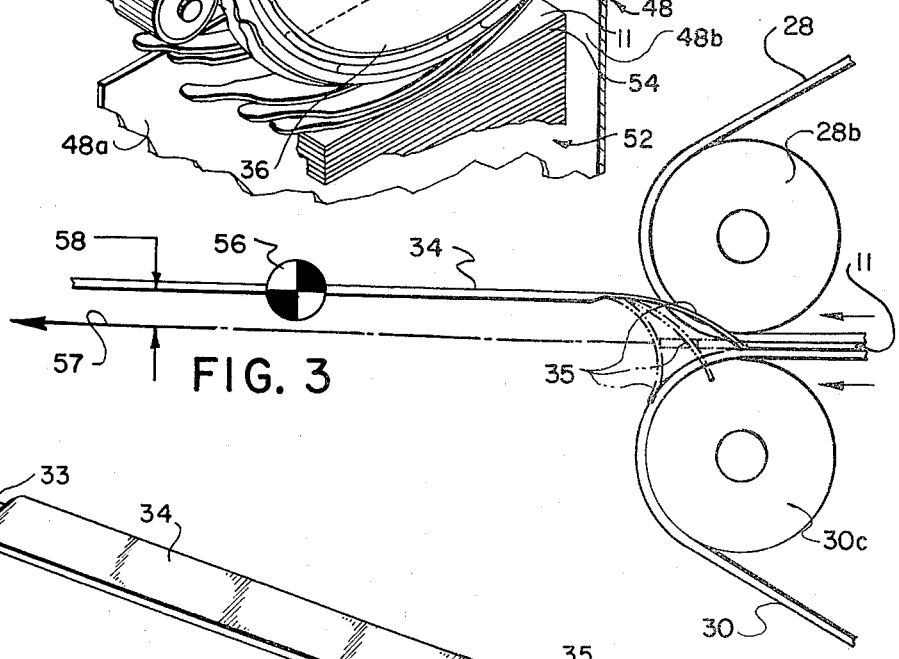
FIG. 3
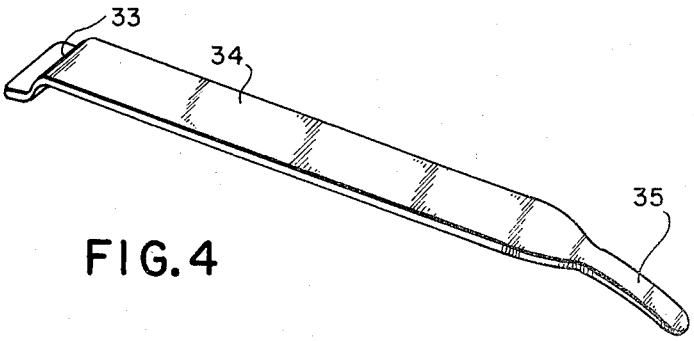
FIG. 4

STACKING MACHINE

BACKGROUND OF THE INVENTION

1. Field of the Invention

The present invention relates to a machine for stacking random sized sheets delivered to it at high speed in either a steady or intermittent fashion. More particularly, the invention is directed toward improvements in stacking machines using a rotating delivery fan or spiral carrier.

2. Description of the Prior Art

Stacking machines of the rotating delivery fan or spiral carrier type are well known. These machines use a rotating member, such as a drum or a plurality of discs mounted for rotation on a common axis. The rotating member includes a plurality of arcuate-shaped, evenly spaced receiving slots designed to respectively receive and decelerate successive sheets fed at a relatively high speed. Adjacent slots are separated by sections or walls of the rotating member, and these walls are shaped to a thin edge to present a minimum edge profile. The successive sheets are fed to the rotating member by a suitable delivery or feeding mechanism, such as a system of feed belts and rollers. It is also known to at least partially enclose the rotating member with a fixed arcuate-shaped member to aid in the retention of the sheets within the respective slots of the rotating member. After a sheet has been inserted into a slot, the rotating member advances it to a stripping station where a stripping member, positioned in the space between adjacent discs or in a slot in the drum, engages the leading edge of the sheet, removes it from the rotating member, and transfers it to a conveyor belt or stacking table. Descriptions of stacking machines of the previously described type are found in U.S. Pat. No. 1,956,541, entitled DELIVERY MECHANISM FOR PRINTING MACHINES; U.S Pat. No. 3,162,439, entitled DOCUMENT STACKING DEVICES; and U.S. Pat. No. 3,355,169, entitled DEVICE FOR DISTRIBUTING WORK PIECES.

U.S. Pat. No. 3,062,537 discloses a machine for stacking sheet material in a receptacle or stacking bin. The apparatus includes a normally stationary stacking drum with means for feeding a sheet along the periphery of the drum to a predetermined position. At this position, means are provided to detect the presence of the sheet, to clamp the sheet to the drum and to initiate rotary movement of the drum, which carries the sheet to a suitable bin or receptacle. Because the rotary movement of the drum is under the control of the moving sheet, this type of device operates asynchronously and thereby eliminates the timing requirements of the stacker relative to the sheet feeding mechanisms of the prior art.

The previously described types of stacking devices are relatively slow because of the nature of the feed and extracting systems. U.S. Pat. No. 3,355,169 is directed to a device intended to increase this operating speed by providing for at least 50 percent more pockets for a given diameter stacker than is provided by a device using slotted wheels. The stacker wheel of the patent includes a disc having a plurality of circumferential closely spaced leaf springs mounted on its periphery. Each of these springs is secured at one end to the peripheral edge of the disc and extends in a generally tangential direction so that each two adjacent springs define an outwardly widening pocket for receiving a sheet for the like. Arcuate guide means, such as rollers or curved bars, are provided to coact with the leaf springs and bend the springs toward the peripheral edge of the rotating disc during part of a rotation to thereby grip the corresponding sheets. The guide means release the leaf springs shortly before they approach a discharge position in the receiving system, thus allowing the sheets to be removed from the wheel.

U.S. Pat. No. 3,912,255 relates to a paper sheet feeding and counting device of the type just described in which the springs or blades cooperate with the pivotal platform for neatly and accurately stacking the sheets. The blades are preferably formed of steel of a stiffness that permits them to flex or bend as they come into engagement with the top-most item on the pivotal platform, thereby preventing the blades from damaging or mutilating the sheet. However, sheet speed with such a device remains low—less than 100 inches per second. Speed beyond 100 inches per second is difficult to achieve because as the speed increases, so does the likelihood that the leading edge of a sheet will collide with the edge of the blade tip and be bounced back, thereby increasing the possibility that a sheet will be forced out of position and miss the stacker or be kicked backward, causing trailing sheets to pile up and jam.

SUMMARY OF THE INVENTION

The present invention is an improved stacking device which stacks sheets asynchronously without varying either the rate of sheet feed or the rate of rotation of the rotating stacker within the stacking device.

In the subject stacker, serially delivered sheets are received by a stacking wheel, which preferably comprises a plurality of rotating discs or wheels mounted for rotation about a common axis. Each rotary disc is provided with a plurality of flexible webs. One end of each web is secured to the periphery of the disc in circumferentially-spaced relationship with the ends of adjacent webs, while the other or free end of each web extends in a direction opposite to the direction of rotation of the stacking wheel so that adjacent webs overlap.

Adjacent overlapping webs form respective pockets for receiving the leading edges of sequential sheets immediately upon the emergence of the respective sheets from the delivery means. The improvement resides in having the free end of each web be more flexible than the sheets with which the stacker is intended to be used so that upon collision between the free end of the web and the sheet, the web will be deflected instead of the sheet. In the prior art as exemplified by the patents described above, the stacking wheels include blades or webs that are made of spring steel or other materials that are more rigid than the sheets being handled by the stacker. Substantial improvements in speed can be obtained as a result of providing a stacker with this improvement.

The improved stacker of our invention may also include movable caging means adjacent the periphery of the rotary discs and which is adapted to move in the same direction and at substantially the same speed as the webs. Such an arrangement causes the webs to be forced against the periphery of the stacking wheel during part of a rotation of the latter to secure the sheets in their respective pockets.

A stripper member is located between the discs and is positioned in the path of the sheets carried in the pockets. Upon engagement of the stripper member with the leading edge of a sheet carried in one of the pockets, that sheet is urged out of its pocket as the webs pass on either side of the stripper member.

The invention and its features and advantages will be set forth and become more apparent in the detailed description of the preferred embodiments presented below.

BRIEF DESCRIPTION OF THE DRAWINGS

In the detailed description of the preferred embodiments of the invention presented below, reference is made to the accompanying drawings, in which:

FIG. 2 is a perspective view of a stacking machine constructed in accordance with the invention;

FIG. 3 is an enlarged detail illustrating the end portion of one of the web members of the stacking wheel;

FIG. 4 is a perspective view of one of the web members;

DESCRIPTION OF THE PREFERRED EMBODIMENT

Because stacking machines are well known, the present description will be directed in particular to elements forming part of, or cooperating more directly with, apparatus in accordance with the present invention. It is to be understood that elements not specifically shown or described may take various forms well known to those skilled in the art.

The preferred embodiment of the improved stacking machine of the present invention will now be described in conjunction with a check cancellation and microfilming apparatus, it being understood, of course, that the machine may be used in other suitable environments.

Figure 1:
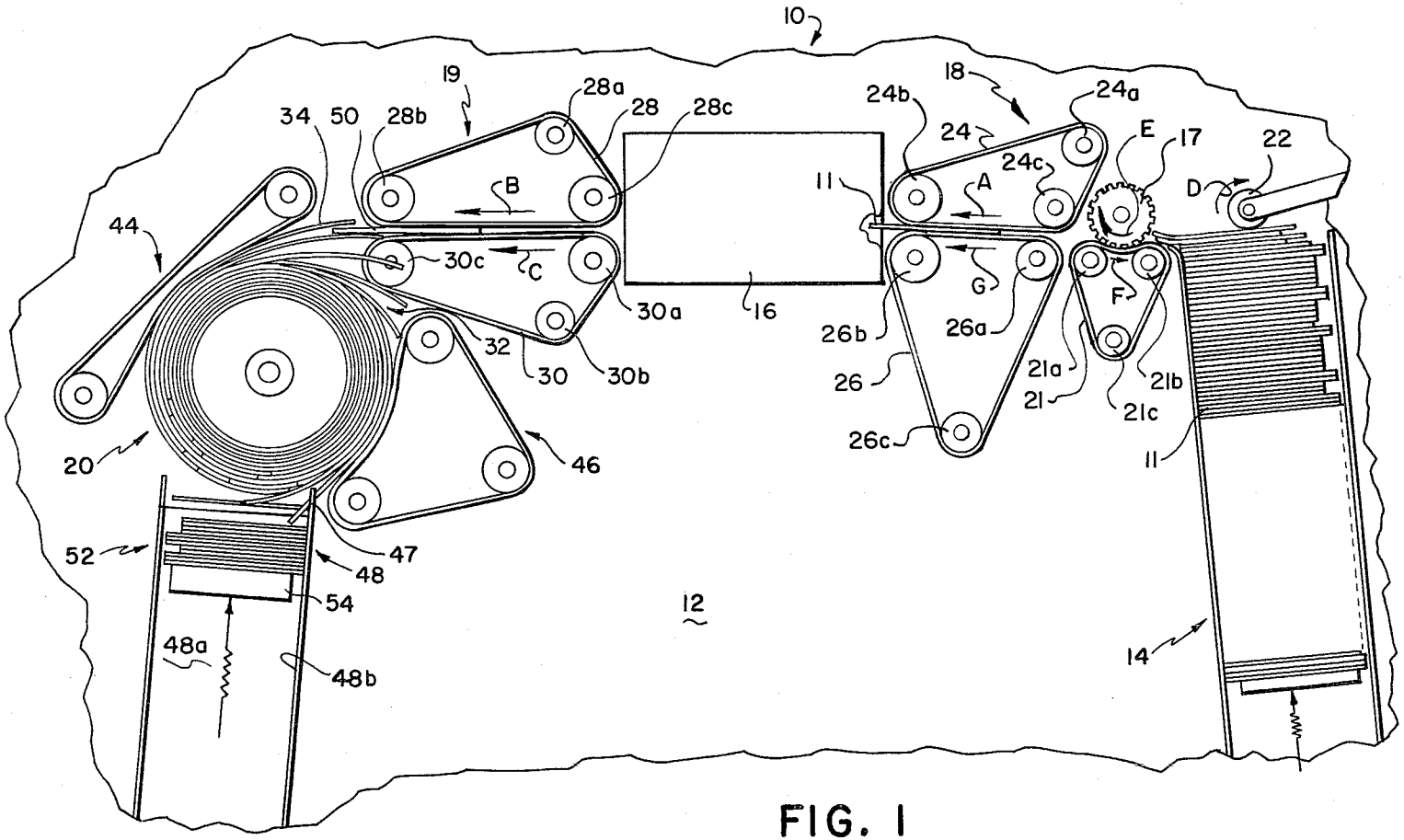
FIG. 1 is a side view of an apparatus including the improved stacking machine of the present invention and showing an example of the environment in which our improved stacking machine may be used.

FIG. 1 shows the components of a combination check cancellation, endorsing, numbering, and microfilming apparatus, generally designated 10. The apparatus 10 is comprised of a housing, a portion of which designated 12 is shown, a spring-biased supply tray 14, a suitable filming and endorsing station 16 for imprinting and microfilming checks, a feed mechanism generally designated 18, a belt transport mechanism 19, and the improved stacking machine of the present invention, generally designated 20.

The feed mechanism 18 is comprised of feed roller 22, serrated separator roller 17, stripper belt 21 and drive belts 24 and 26. The stripper belt 21 is trained over rollers 21*a*, 21*b* and 21*c* and is driven in a direction counter to separator roller 17 and drive belts 24 and 26. Drive belt 24 is trained over rollers 24*a*, 24*b* and 24*c* and drive belt 26 is trained over rollers 26*a*, 26*b* and 26*c*. Checks or sheets 11 are loaded into the spring loaded supply tray 14 which urges the uppermost sheet against feed roller 22. Roller 22 is mounted on housing 12 in such a manner that upon rotation of the roller 22 in a clockwise direction, as shown by arrow D, it frictionally advances the uppermost sheet 11 into the nip formed by separator roller 17 and stripper belt 21. Separator roller 17 and stripper belt 21 are both driven in a clockwise direction, as shown by arrows E and F in FIG. 1. Separator roller 17 moves at a higher linear speed than stripper belt 21. When a sheet is advanced into the nip formed by separator roller 17 and stripper belt 21, the higher coefficient of friction between separator roller 17 and the sheet 11 than between the sheet 11 and the stripper belt 21 ensures insertion of only one sheet 11 into drive belts 24 and 26 of the feed mechanism 18. Drive belts 24 and 26 are driven in opposite directions as shown by arrows A and G in FIG. 1. Drive belt 24 is driven in a clockwise direction with drive belt 26 being driven in a counterclockwise direction. Drive belts 24 and 26 accelerate the sheets above the linear speed determined by separator roller 17 to insure that the sheets are in a spaced apart relationship when they arrive at the filming and endorsing station 16. After filming and endorsing within station 16, the sheet is fed into the belt transport delivery mechanism 19, comprising belts 28, 30 which further accelerate the sheet. Belt 28 is trained over a plurality of rollers 28*a*, 28*b* and 28*c* and is driven in a clockwise direction as indicated by arrow B. Belt 30 is similarly trained over rollers 30*a*, 30*b* and 30*c*, but is driven in the opposite or counterclockwise direction as indicated by arrow C. Typically, sheets may exit the station 16 at the speed of 180 inches/second and upon entering the belt transport 28, 30, the sheet will be accelerated to a speed of 300 inches/second. By accelerating the sheets through the belt transport 28, 30 it is insured that the sheets are delivered individually in a spaced-apart relationship to the stacking device 20 for proper stacking.

Figure 5:
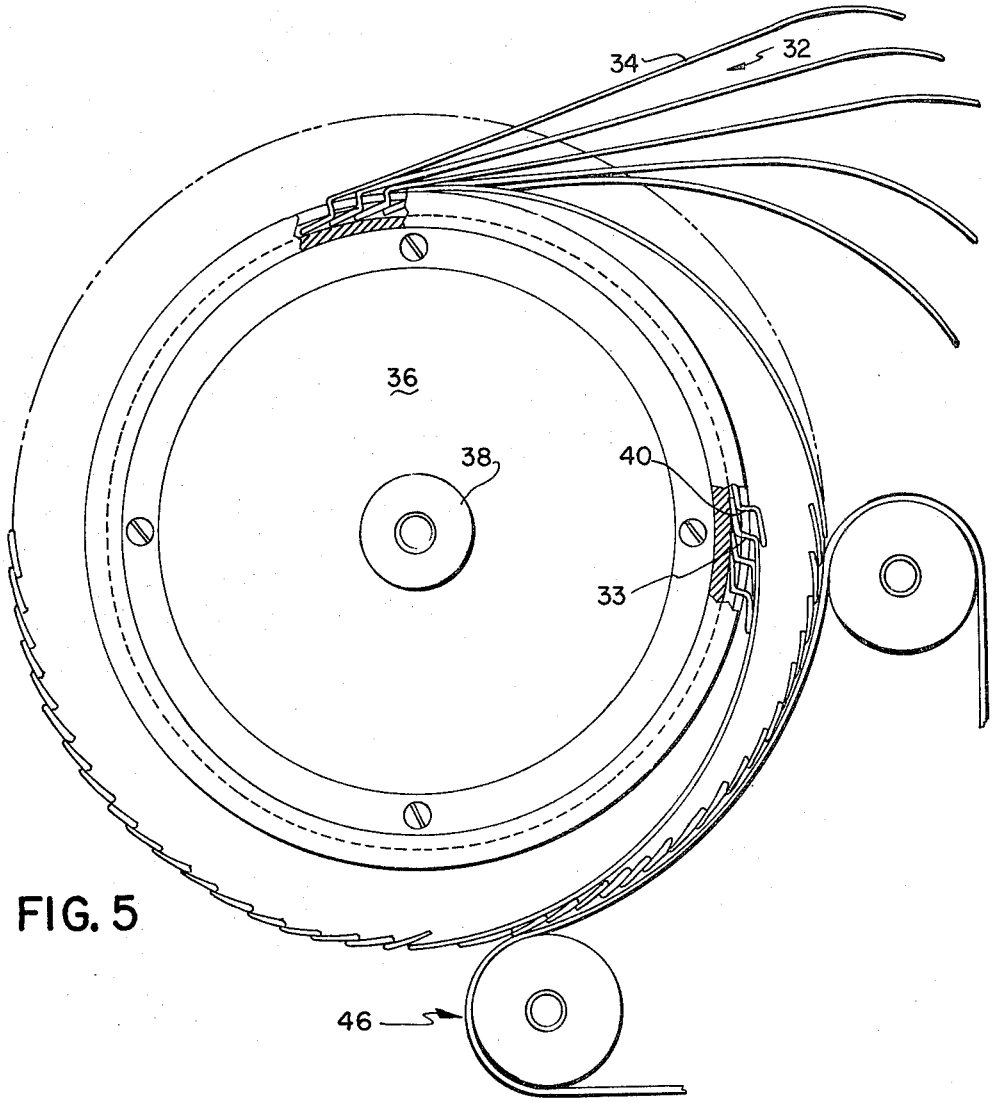
FIG. 5 is a side view of one of the rotary stacking discs of our improved stacking wheel.
Figure 6:
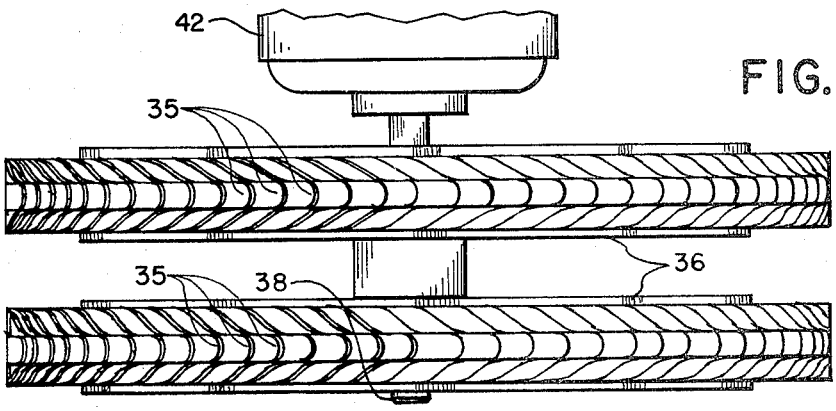
FIG. 6 is a top view illustrating two rotary stacking discs axially aligned on a common shaft.

FIG. 2 illustrates in more detail the components of the stacking machine 20, which is capable of receiving either a steady or intermittent flow of sheets of varying lengths, widths, and thicknesses which are randomly discharged from the belt transport system 19 into respective pockets 32 formed by adjacent flexible blades 34. The stacker includes a stacking wheel assembly comprising a plurality of metal stacking discs 36 which are fixedly mounted on a common shaft 38 in a spaced-apart relationship. It is evident that it is within the scope of the invention to provide only one stacking disc or more than two. If each stacking disc is approximately 9" in diameter, it preferably would have approximately seventy-two flexible webs 34 with each web having one end thereof secured to the periphery of the disc by suitable fastening means such as the L-shaped notches 40 illustrate in FIG. 5. As can best be seen in FIG. 5, the free ends of the flexible webs 34 extend in an approximately tangential direction with reference to the periphery of the disc so that an outwardly opening pocket 32 is defined between each two adjacent webs. both of the discs on the common shaft 38 are in rotational alignment such that the pockets 32 formed by the flexible webs 34 are directly opposite one another; whereby upon rotation of the shaft 38 by a motor 42 or other suitable means, the discs 36 will rotate with their webs and pockets in synchronism. It should be understood that even though a circular disc is shown for purposes of illustration, an endless conveyor or the like could be substituted for the discs.

Located around the periphery of each of the stacking discs are two caging belts 44 and 46, each of which can be driven by appropriate means such as motors (not shown). The first caging belt 44 causes the flexible webs 34 to hug the periphery of the disc, resulting in a pinching action on the sheets 11 being fed into the pockets 32; thereby decelerating the sheets 11 relative to the disc and causing sheets 11 to move with the webs. The pinching action of this first caging belt 44 is allowed to continue until just prior to the sheet's arrival at a stripping station 48 which will be discussed in more detail later.

The second caging belt 46 is located just beyond the stripper station 48 and again presses the flexible webs 34 in toward the periphery of the discs and releases them just prior to their arrival at the exit nip 50 of the belt transport section 19. This second caging belt 46 prevents the flexible members 34 from wiping against the stationary edge 47 of the receiving hopper 52 of the stripper station 48 but allows the flexible webs 34 to spring out and separate radially from each other to facilitate sheet insertion. By having the belts 44, 46 travel at the same linear speed as the flexible webs 34, there is no wear incurred by the flexible webs 34 other than that inflicted by the sheets 11 during insertion and removal. Thus, as a sheet 11 leaves the exit nip 50 of belt transport 19 it is inserted into aligned pockets 32 of the stacking device 20, which causes the sheet 11 to decelerate as it moves deeper into the pocket 32 and the flexible web members begin to grip the sheet as a result of the caging belt 44.

It should be noted that two or more stacking discs 36 may be used in parallel. The spacing of the discs can be varied depending on the width of the sheets being handled. Such adjustment is accomplished by moving the discs along the shaft 38 and securing them at the appropriate separation distance. In addition, the position of the caging belts 44 and 46 associated with each disc is adjustable in a direction parallel to the shaft 38 to bring each caging belt into alignment with its associated disc. Such an arrangement has the advantage that the two outer edges of the flexible webs 34 can be adjusted to overlie the corners of the sheet 11 so that they are protected, thus preventing interference with subsequent sheets.

Once properly inserted in a receiving pocket 32, the sheet 11 is conveyed by the rotation of the discs 36 to a stripping member 49, which extends into the space between adjacent discs of the stacker 20. As the stacker discs rotate, the leading edge of the sheet 11 positioned in the pocket 32 engages the stripping member 49, thereby forcing the sheet 11 out from between the flexible webs 34 and depositing it on a spring-biased stacking platform 54 which is slightly angled from the vertical so that as subsequent sheets 11 are stripped from the pockets 32, the sheets tend to fall against adjacent back and side walls **48*a* and 48*b*** which guide the sheets being stacked so that sheets being stacked are in alignment along two adjacent edges.

The flexible webs 34 are made of a plastic-like material with the shape and the size of the web being selected such that the degree of flexibility (at the tip of the web) is more flexible than the sheets being handled. This use of flexible webs 34 to define discrete pockets prevents occasional damage or alteration to either the flexible web 34 or the sheet 11 from occurring when an occasional sheet collides with the tip of a flexible web 34. The tip 35 of the flexible web 34 is preformed in such a manner that it has a slight downward bend to the tip 35 (FIG. 3). Since the collision force thrust line 57 of the entering sheet 11 is directed to one side of the center of mass 56 of the flexible web 34, by the moment arm 58, the tip 35 remains engaged with the entering sheet 11 and easily flexes (as shown in phantom) further away from the center of mass 56 of the web 34 to comply with the rotational force being applied to the web 34. At some point, usually before the blade has flexed by more than 180°, the tip 35 will disengage the sheet 11 and resume its original shape. Thus, occasional collisions of a sheet with the tip of a web result in the web being flexed rather than the sheet crumbling which substantially precludes the likelihood of a jam in the machine. This enables the machine to operate at substantially higher speeds by insuring that an entering sheet will be guided into a discrete pocket.

Various materials can be used for the flexible blade members 34, such as 0.010" thick Mylar, trademark of E.I. DuPont de Nemours and Co., Inc. for a polyethylene terephthalate plastic material, 0.010" thick nylon and 0.010" thick clear polycarbonate. All flexible members were 1" wide by approximately 10" long, not including the additional material required to form the "Z" shaped mounting element 33 which is inserted in a corresponding narrow slot 40 in the wheel rim (FIG. 5) to frictionally retain the web on the disc.

It was found that metal materials are not particularly suitable because they are too easily bent beyond their elastic limit, were noisy and were deemed dangerous to the operator during unloading operation because burrs tended to form on the edges of the metal. Of the three materials tested for the blades, polycarbonate proved most satisfactory because of its ability to be cold formed and because of its resistance to delamination and deformation. It should be noted that the best results were obtained using tapered polycarbonate (clear) webs with the thick end or root of the web being 0.010 inches to 0.070 inches gradually tapering at the tip to a thickness of 0.006 inches with a slight downward bend at the tip. The tip also narrows in width at the very end, generally forming a rounded tip. It is not necessary that the flexible tip actually be an integral part of the web e.g., the tip portion could be a thinner piece of polycarbonate attached by methylene chloride cement to a thicker piece of polycarbonate having uniform thickness. Tips of many different materials could be attached to the main web by various means such as riveting or by using an elastic hinge connection.

As mentioned earlier, a single stacking disc could be used instead of the double course of flexible webs and discs illustrated in the drawings. A single disc would be located in the best compromise location between the dimensional width extremes of the sheets and the stripping station 48 would be modified in such a manner that it would straddle the stacking disc. However, with such an arrangement, additional means may be necessary and could be provided to prevent the turn-down trailing edge of a first entering sheet from being caught by the bent corners of the leading edge of the following sheet.

It should also be noted that where two or more courses of flexible webs 34 are used in the stacking device 20, it is not essential that a sheet enter two pockets 32 located on different discs exactly opposite one another, but may in fact enter one pocket or one disc that is ahead or behind a pocket on the other disc. This is possible because the webs 34 are sufficiently thin and flexible so that they do not significantly warp or twist the sheet 11. Because the sheet 11 has been slowed down and all motion relative to the assembly of the flexible webs has been stopped prior to the sheet's leading edge striking the roots of its respective pocket 32, lack of exact alignment between the pocket roots does not skew or displace the sheet 11 from its original trajectory to an extent that orderly stacking is impaired.

The invention has been described in detail with particular reference to a preferred embodiment thereof, but it will be understood that variations and modifications can be effected within the spirit and scope of the invention.

What is claimed is:

1. In a device for transporting through a curved path, sheets received seriatim at high speed, wherein a plurality of overlapping web elements are attached at one end of each element to the periphery of a member which is rotatable in the direction of said attached ends, the other ends of the web elements being free to move relative to each other to provide sheet receiving pockets between adjacent web elements, the improvement wherein said pocket providing ends of the web elements have a preformed bend toward the rotatable member and are more flexible than the leading edge portions of the sheets so that upon collision between an incoming sheet and a web tip, the web is deflected, because of its flexibility and preformed bend, toward the rotatable member to insure reception of the sheet between that web and an adjacent underlying web.

2. The device as set forth in claim 1 wherein said web elements are tapered so that the thickness of said attached end is greater than the thickness of said free end.

3. The device as set forth in claim 1 wherein said web elements narrow in width so that the width of said attached end is greater than the width of said free end.

4. In a device for stacking sheets delivered to it from a supply station, said device including:

a rotary assembly including a rotary member, said assembly being rotatable in a predetermined direction and having a plurality of pockets each of which is adapted to receive and retain the leading end of a sheet delivered from said supply station;

caging means for releasably retaining within each of said pockets the end of the sheet received by said pocket; and sheet removal means for removing said retained sheet from said pocket at a predetermined location;

the improvement comprising pocket forming means including a plurality of webs having opposite first and second ends, said webs being secured by their respective first ends to said rotatable member with their respective second ends extending in overlapping relation in a direction opposite the direction of rotation of said assembly, said first ends of said webs being thicker and wider than said second ends, and each of said second ends having a preformed bend toward said rotary member, so that said second ends are sufficiently flexible and sufficiently bent toward said rotary member to deflect toward said rotary member when a sheet being delivered to said device collides with the second end of a web, thereby insuring insertion of that sheet into the pocket defined by the deflected web and the adjacent web overlapped thereby.

5. In a stacking mechanism for stacking sheets having a first degree of flexibility, said mechanism including:

a rotatable member;

a plurality of flexible webs having first and second ends with said first end of each web being fixed to said member, each two adjacent webs defining a pocket;

means for rotating said member in the direction of said first ends;

movable caging means adjacent the periphery of said member, said webs being in engagement with said caging means during a portion of the rotation of the member while said caging means is moving in the same direction and at substantially the same speed as said webs, thereby forcing said webs against the periphery of said member;

means for moving said caging means;

a stripper member adjacent said rotatable member and positioned in the path of the sheets carried in said pockets to remove said sheets from said member; and receiving means positioned to accumulate sheets removed by said stripper member;

the improvement wherein the second end of each web is thinner and more narrow than said first end thereof so that it is more flexible than the leading ends of said sheets so that upon a collision between a sheet and the second end of a web, the web is deflected more than the sheet; and wherein the second end of each web has a preformed bend toward said rotatable member so that upon a collision between a sheet and the second end of a web, the web is deflected toward the rotatable member to insure insertion of the sheet between that web and an adjacent underlying web.

6. In a device for stacking sheets delivered to it seriatim at high velocity, said device including:

a member continuously rotatable in a predetermined direction; and means for rotating said member, the improvement comprising:

a plurality of flexible webs, each secured at a first end thereof to the periphery of said rotatable member, the second ends of said webs extending in overlapping relation opposite to said predetermined direction, whereby each pair of adjacent webs on said member defines a pocket adapted to receive the leading end of a sheet, one of said pockets being always in sheet-receiving alignment with the path along which sheets are delivered, said second end of said webs being thinner and narrower than said first end and having a preformed bend toward said rotatable member, said second end of said webs being sufficiently flexible and sufficiently bent toward said rotatable member so that upon a collision between the leading edge of a sheet being delivered to said device and the second end of a web, the web is deflected more than the sheet and is deflected toward the rotatable member, thereby insuring insertion of that sheet into the pocket defined by the deflected web and the adjacent web overlapped thereby.

7. A device as set forth in claim 4, wherein said webs are made of polycarbonate, and the first end of said webs are approximately two to eleven times thicker than the second end of said webs.

* * * * *

UNITED STATES PATENT AND TRADEMARK OFFICE

CERTIFICATE OF CORRECTION

PATENT NO. : 4,228,997

DATED : October 21, 1980

INVENTOR(S) : Edward B. Schoonmaker et al.

It is certified that error appears in the above—identified patent and that said Letters Patent is hereby corrected as shown below:

Column 4, line 47, "illustrate" should read -- illustrated --.

Column 4, line 51, "both" should read -- Both --.

Signed and Sealed this

*Third* Day of *February 1981*

[SEAL]

*Attest:*

RENE D. TEGTMEYER

*Attesting Officer*

*Acting Commissioner of Patents and Trademarks*